US005437227A

United States Patent [19]

Straubinger

[11] Patent Number: 5,437,227

[45] Date of Patent: Aug. 1, 1995

[54] DOCTOR BAND DISPLACEABLE PARALLEL TO CYLINDER'S AXIS OF ROTATION

[75] Inventor: Werner Straubinger, Nürnberg, Germany

[73] Assignee: U. E. Sebald Druck und Verlag GmbH, Nuremberg, Germany

[21] Appl. No.: 163,704

[22] Filed: Dec. 9, 1993

[30] Foreign Application Priority Data

Dec. 16, 1992 [DE] Germany ..... 42 42 582.4

[51] Int. Cl.[6] ..... B41F 9/10; B41F 9/14

[52] U.S. Cl. ..... 101/169; 101/156; 101/168; 101/162; 101/157

[58] Field of Search ..... 101/156–160, 101/162, 164, 166, 168–169, 155, 167

[56] References Cited

U.S. PATENT DOCUMENTS

| | | | |
|---|---|---|---|
| 2,148,455 | 2/1939 | Golber et al. | 101/157 |
| 3,888,172 | 6/1975 | D'Amato et al. | 101/168 |
| 4,074,627 | 2/1978 | Eck et al. | 101/168 |
| 4,922,821 | 5/1990 | Nozaka et al. | 101/168 |

FOREIGN PATENT DOCUMENTS

| | | | |
|---|---|---|---|
| 1218756 | 5/1960 | France . | |
| 228215 | 12/1909 | Germany . | |
| 3428073 | 1/1986 | Germany . | |
| 9017689 | 9/1991 | Germany . | |
| 0484756 | 5/1938 | United Kingdom | 101/157 |

*Primary Examiner*—Edgar S. Burr
*Assistant Examiner*—Lynn D. Hendrickson
*Attorney, Agent, or Firm*—Sughrue, Mion, Zinn, Macpeak & Seas

[57] ABSTRACT

A doctor arrangement for a rotary intaglio printing machine comprises a doctor to remove excess ink from the plate cylinder. The doctor is in the form of a band which extends parallel to the axis of rotation of the plate cylinder against which it is pressed by a doctor bar. The doctor band is so flexible that it can be wound on and unwound about axes which extend transversely to its longitudinal direction and the doctor band is so mounted and guided at the doctor bar that it is displaceable relative thereto in the longitudinal direction, the length of the doctor band being substantially greater than the axial length of the plate cylinder. A respective winding device for winding on and unwinding the doctor band is arranged in the region of each of the axial ends of the plate cylinder. A drive means displaces the doctor band along the doctor bar during the printing operation when the doctor band is unwound from the one winding device and wound on to the other winding device.

9 Claims, 2 Drawing Sheets

MEMORY
27
34
3
II
II
31
S
29
33
40
38
35
18
25
39
37
22
6
4
7
R
20
S
32
1
30
28
36

DOCTOR BAND DISPLACEABLE PARALLEL TO CYLINDER'S AXIS OF ROTATION

BACKGROUND OF THE INVENTION

The present invention concerns a doctor arrangement for a rotary intaglio printing machine.

In a rotary intaglio printing machine the printing ink which is to be transferred on to the material to be printed such as a web or sheets of paper is applied to the plate cylinder of the machine by a procedure wherein the plate cylinder which rotates at a high speed of rotation dips with a region of its peripheral surface which extends over the entire length of the plate cylinder into a bath of printing ink which is contained in an ink trough or fountain. When that happens the depressions in the peripheral surface of the plate cylinder are filled with printing ink. As excessive printing ink adheres to the peripheral surface of the plate cylinder at regions of the surface which do not have depressions, after the peripheral surface of the plate cylinder issues from the bath of printing ink, it is absolutely essential to arrange at the printing cylinder a device known as a doctor, by means of which that excess printing ink can be scraped off the plate cylinder before the respective region of the surface of the plate cylinder passes into the printing zone where it comes into contact with the web of material to which the printing is to be applied.

A conventional doctor is usually in the form of a relatively stiff metal blade, the length of which is somewhat greater than the axial length of the associated plate cylinder. Such a doctor is rigidly clamped in position in an equally long and massive doctor bar, by means of which it is so positioned beside the plate cylinder that it can be pressed against the peripheral surface of the plate cylinder by means of a hydraulic or pneumatic device, along a generatrix which extends along the plate cylinder parallel to the axis of rotation thereof.

In order to avoid local overheating of and thus damage to the surface of the plate cylinder as a result of the pressure applied by the doctor to the peripheral surface of the plate cylinder, the entire doctor arrangement, that is to say the doctor together with its doctor bar and the entire pressing assembly, can be periodically moved to and and fro by a few centimeters in a direction parallel to the axis of the plate cylinder.

However that doctor arrangement suffers from a number of disadvantages. For example the durability of such a doctor is limited to about 500,000 to 700,000 revolutions of the printing cylinder, even in completely trouble-free operation. That remains that, when the machine is required to perform a very long print run which can involve producing a printed product in very high numbers which can be the order of magnitude of up to for example twelve millions, the doctors of all the printing mechanisms of the machine have to be replaced a number of times during the operation of printing such a number of items. For that purpose it is necessary for the rotary intaglio printing machine to be stopped until the doctors to be changed have been removed and replaced by new doctors. The machine stoppage times caused thereby result in a delay in finishing the respective print run to be produced, and give rise to increased costs. In addition a rotary printing machine which operates at high speed cannot be abruptly stopped and quickly accelerated to full speed again from a stopped condition. While the speed of rotation is being reduced and raised again prior to and after a change of doctor, a large amount of waste occurs, as it is in practice not possible to keep the register condition of the various printing mechanisms properly adjusted with the required degree of accuracy during the periods in which the speed of rotation of the intaglio printing machine is varying.

The above-discussed problem is aggravated by the fact that at any time, that is to say even after just a few hundreds of revolutions, a doctor can suffer from damage due to a lump of ink or the like which is pressed through between the peripheral surface of the plate cylinder and the doctor. Such damage makes itself noticeable straightaway because the web of material to which printing is to be applied can be seen to have a continuous ink stripe which extends to and fro in a zig-zag configuration, because of the above-mentioned reciprocating movement of the doctor. Hitherto, in such a situation the rotary intaglio printing machine had to be immediately stopped and the damaged doctor had to be replaced, which also gives rise to the above-described disadvantages.

SUMMARY OF THE INVENTION

An object of the present invention is to provide a doctor arrangement for a rotary intaglio printing machine such that, even when printing very high numbers of items, machine stoppage times can be very substantially eliminated and the amounts of waste which occur due to damage to the doctor can be considerably decreased.

Another object of the present invention is to provide a rotary intaglio printing machine with a doctor arrangement which remains effective over a long period of operation to remove excess ink from the plate cylinder of the machine in an efficient manner and with a reduced incidence of fouling with ink in the area around the doctor arrangement.

According to the present invention the foregoing and other objects are attained by a doctor arrangement for a rotary intaglio printing machine comprising a doctor in the form of a flexible band which extends along the plate cylinder parallel to the axis of rotation of the plate cylinder, and a doctor bar which guides the doctor band and presses it against the peripheral surface of the plate cylinder for stripping excess ink from the plate cylinder, the doctor band being so mounted and guided at the doctor bar that it is displaceable relative to the doctor bar in the longitudinal direction. The doctor band is so flexible that it can be wound on and unwound about axes which extend transversely to its longitudinal direction, while the length of the doctor band is substantially greater than the axial length of the plate cylinder. A respective winding device is arranged in the region of each of the axial ends of the plate cylinder, for winding on and unwinding the doctor band. The doctor arrangement further has a drive means for displacing the doctor band in the longitudinal direction during a printing operation, with the doctor band being unwound from the one winding device and wound on to the other winding device.

It will be noted in this respect that a matter of particular significance is that the doctor band is substantially longer than the operatively associated plate cylinder. Thus, it can be provided for example that the doctor band is of a length of 200 meters. The doctor band is firstly wound on one of the two winding device from which it is drawn with a feed movement along the plate cylinder slowly and continuously at a speed that for example corresponds to the speed of the previously conventional reciprocating movement referred to above. The doctor band is thus unwound from the above-mentioned one winding device and wound on to the oppositely disposed winding device.

If the doctor band has been completely unwound from one winding device and wound on to the other before a print run has been finished, its direction of movement can be reversed and the doctor band can thus be wound back on to the initial winding device. When dealing with very high numbers of items to be printed in a print run, that reversal in direction may also be effected a number of times. Because of the slow speed of feed movement of the doctor band, the band, in each of those reversals in direction, can be stopped and set in motion again in the opposite direction, so quickly that there is no noticeable interruption in the relative movement between the doctor band and the plate cylinder. Therefore there is no need to reduce the printing speed or stop the printing machine at all, to provide for such a reversal in the movement of the doctor band.

As each portion of the doctor band only bears against the surface of the plate cylinder for a relatively short time, the amount of wear of the doctor band is greatly reduced. Therefore, with the doctor band arrangement according to the invention, it is possible to produce printing runs of up to for example ten or twelve millions of items, without the rotary intaglio printing machine having to be stopped in the meantime, to replace a doctor. In that way both the stoppage times and also the amount of wastage can be considerably reduced.

Preferably the doctor band comprises a thin metal strip or foil whose side which bears against the plate cylinder is automatically ground to the shape of the peripheral surface of the cylinder when it is first wound from one winding device on to the other.

In order on the one hand to ensure that the doctor band is properly guided and on the other hand in order to minimize the amount of force to be applied to cause the doctor band to be wound from one winding device on to the other, the surfaces of the gap in the doctor bar, against which the doctor band bears and along which it slides, are preferably ground.

As, with a doctor arrangement according to the invention, the possibility of local damage to the doctor band due to lumps of ink or the like which are pressed through between the plate cylinder surface and the doctor band cannot be excluded, in accordance with a preferred feature of the invention the drive means with which the doctor band is wound from one winding device on to the other can be switched over from the normal low feed speed to a substantially increased feed speed in the event of damage to the doctor band so that damaged locations, after they have occurred, can be quickly moved out of the region of contact with the surface of the plate cylinder. The occurrence of damaged locations of that kind is preferably detected by the provision of suitable sensor devices.

In accordance with an advantageous embodiment of the invention there are provided memory means in which one or more positions at which damage has occurred on a doctor band can be stored. On the basis of those stored data, while the doctor band is again being wound from one winding device on to the other, the drive means can immediately be switched over to an increased feed speed when such a damage location on the doctor band passes into the region of contact with the surface of the plate cylinder. That procedure of quickly moving past or skipping damage on the doctor band makes it possible for the amount of wastage caused by such damage locations to be kept extremely low and for the doctor band to be still put to further use as long as it does not have to many damage locations of that kind.

In accordance with a further preferred feature of the invention the doctor bar is so positioned that the doctor band is pressed against a generatrix of the plate cylinder, which, in the direction of rotation of the latter, lies downstream of the ink trough, not above and preferably below the cross-sectional center of the plate cylinder, that is to say, a horizontal line through the axis of rotation of the plate cylinder. In that way the amount of printing ink which circulates between the surface of the ink bath feeding the plate cylinder, the surface of the plate cylinder when it emerges from the surface of the ink bath, the doctor band which scrapes off the excess printing ink, and a guide surface for returning the scraped-off ink back into the printing ink bath, can be kept extremely low. Because of the resulting reduction in ink swirls and the reduced possibility of ink and air being mixed together, the amount of ink accumulation in the region of the doctor arrangement can be considerably reduced, and the assembly involves substantially less fouling both of the whole doctor arrangement and also the entire area around same, in particular the plate and impression cylinder mountings.

Further objects, features and advantages of the invention will be apparent from the following description of a preferred embodiment.

DESCRIPTION OF THE PREFERRED EMBODIMENT

Figure 1:
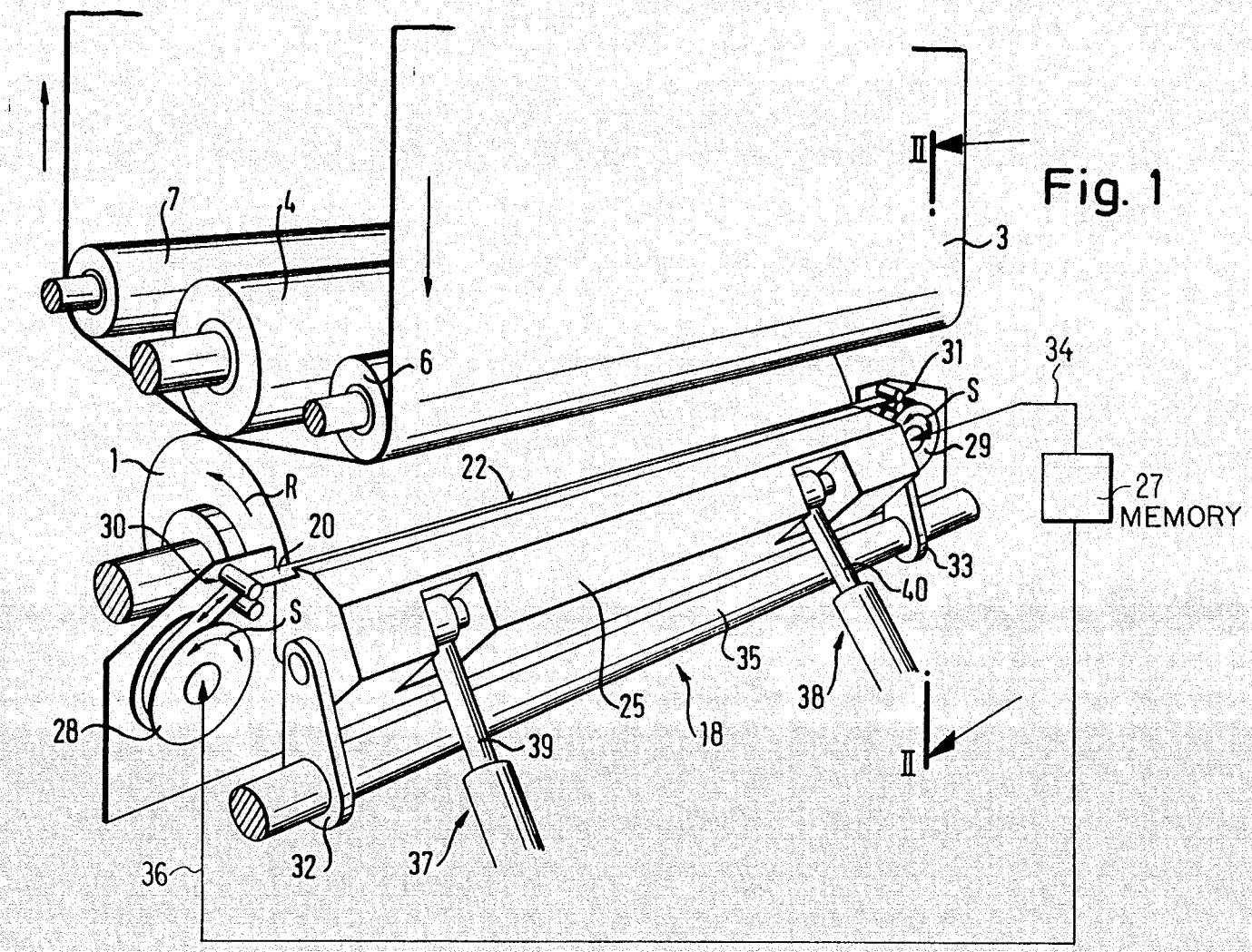
FIG. 1 is a diagrammatic perspective view of part of a printing mechanism of a rotary intaglio printing machine on which a doctor arrangement according to the invention is mounted.

Referring now to the drawings, shown therein is part of a printing mechanism of a rotary intaglio printing machine which may have a plurality of printing mechanisms. Reference 1 denotes a plate cylinder of the printing mechanism shown, while reference 3 denotes a web of paper to be printed upon, which is pressed against the peripheral surface of the plate cylinder 1 by means of an impression cylinder 4. Two guide spindles 6 and 7 are provided for diverting the web of paper 3 which is fed vertically to the printing region into a horizontal direction and for diverting it into a vertical direction again after it has passed through the printing region.

It should be expressly pointed out here that the doctor arrangement according to the invention is independent of that specific manner of feeding and guiding the web to be printed upon, and it can also be used for example when the web passes through the printing regions of a plurality of successive printing mechanisms without a change in direction, substantially in a straight line, for example horizontally or vertically.

Figure 2:
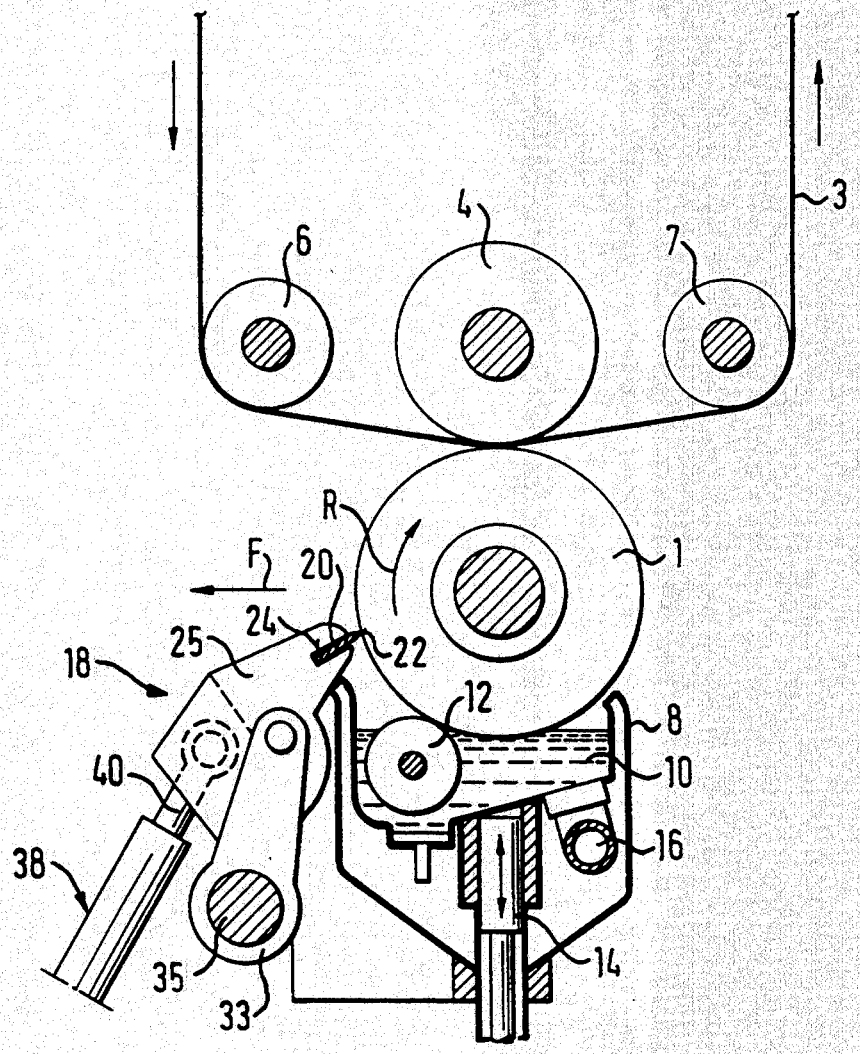
FIG. 2 is a view of the arrangement shown in FIG. 1 in section taken along line II—II.

As can be seen in particular from FIG. 2, the plate cylinder 1 dips with the lower part of its peripheral surface into a bath of printing ink 10 which is disposed in an ink trough or fountain 8 and which is urged into the depressions in the plate cylinder 1 by means of an inking roller 12, the peripheral portion of which comprises for example plush material.

The ink trough 8 is adjustable in a vertical direction by means of a diagrammatically indicated lift device 14 which for example is pneumatically or hydraulically operated. In that way the ink trough 8 can be easily lowered if the plate cylinder 1 of a printing mechanism is to be replaced, for which purpose the plate cylinder 1 is moved out of the printing mechanism in the horizontal direction as indicated by the arrow F. In addition a printing mechanism may often use plate cylinders of different diameters so that it is necessary for the height of the ink trough 8 to be adjusted in dependence on the diameter of the respective plate cylinder 1 which is being used, in such a way that the peripheral surface thereof always dips into the printing ink 10 in the illustrated manner and comes to bear against the peripheral surface of the inking roller 12 which also moves with the ink trough 8.

Printing ink can be continuously added to the ink trough to the extent that it is consumed by the printing operation, by means of a pipe 16 which extends in the longitudinal direction of the ink trough.

In order to scrape off excess ink adhering to the regions of the peripheral surface of the plate cylinder 1 which come out of the ink trough 8 after contact with the inking roller 12 by virtue of the rotary movement of the plate cylinder in the direction indicated by the arrow R, disposed downstream of the ink trough 8 in the direction of rotation R of the plate cylinder 1 is a doctor arrangement as generally identified by reference 18 and which serves to press a doctor which in this case is formed by a thin metal band 20 against the peripheral surface of the plate cylinder 1 along a generatrix which is parallel to the axis of rotation of the plate cylinder 1, in such a way that the doctor band 20 closely conforms to the plate cylinder 1 with the ground edge 22 of the doctor band 20, that is towards the plate cylinder 1. It will be seen that the edge 22 of the doctor band 20 is automatically ground to the shape of the peripheral surface of the plate cylinder 1 in initial operation of the doctor band 20.

As can be seen in particular from FIG. 2, the doctor arrangement 18 is so positioned relative to the plate cylinder 1 that the line of contact between the edge 22 of the doctor band 20 and the peripheral surface of the plate cylinder 1 is at the highest at the level of and preferably below the horizontal line extending along the diameter of the plate cylinder 1. That relationship can reduce the amount of ink and therewith also the dynamic pressure of the ink (not shown) which, as a result of the rotary movement of the plate cylinder 1 and the scraper effect of the doctor band 20, accumulates beneath the doctor band 20 and seeks to move it away from the peripheral surface of the plate cylinder 1.

The doctor band 20 is mounted and guided in a slot 24 extending in a doctor bar 25 in the longitudinal direction thereof, the width of the slot 24 being slightly greater than the thickness of the doctor band 20. For the sake of clarity, in FIG. 2 the width of the slot 24 and the thickness of the doctor band 20 are shown as enlarged, in relation to the other parts. The dynamic pressure of the accumulated ink beneath the doctor band 20 and the friction of the doctor band 20 against the plate cylinder 1 causes the doctor band 20 to be somewhat tilted in the slot 24 so that it bears against the upper wall of the slot 24 with its top surface in the front region which is towards the plate cylinder 1 while in the rear region which is remote from the plate cylinder 1, the doctor band 20 bears with its underside against the respective lower wall of the slot 24. The two walls of the slot are ground so that the doctor band 20 can be displaced in the longitudinal direction relative to the walls of the slot 24 during a printing operation without the application of an excessive amount of force.

To perform that feed movement of the doctor band, the assembly has winding devices 28 and 29 which are shown in FIG. 1 and which can be driven in rotation in such a way that one of the winding devices 28, 29 winds on the doctor band 20, to the extent to which it was unwound from the other winding device 29, 28. In that respect the double-headed arrow S in FIG. 1 indicates that the direction of that winding movement and therewith also the direction of longitudinal feed movement of the doctor band 20 can be reversed.

In order to ensure that the doctor band 20 is accurately guided into and out of the longitudinal slot 24 in the doctor bar 25, in spite of the varying diameter of the coil of doctor band 20 disposed on each of the two winding devices 28 and 29, a respective guide arrangement 30, 31 each consisting of two rotatable rollers is provided between the doctor bar 25 and each of the two winding devices 28, 29 in the region of the respective ends of the plate cylinder 1. The rollers of the guide arrangements 30, 31 can either rotate freely with the doctor band 20 or however they can preferably serve to drive the doctor band 20, whereby it is possible to operate with a constant speed of rotation for a uniform movement of the doctor band 20 in the longitudinal direction. In that respect, the guide arrangement 30, 31 towards which the doctor band is moving, can be operated in each case somewhat faster than the other guide arrangement, in order to maintain a defined longitudinal tension in the doctor band 20. In that way the winding devices 28, 29 are relieved of the load of the tensile effect of the doctor band 20. Only the winding device which winds on the doctor band 20 has to be driven at such an instantaneous speed that the doctor band 20 is wound on with turns which are not too loose.

Each of the two winding devices 28, 29 is so dimensioned that it can receive a length of the doctor band 20, which is substantially greater than the axial length of the plate cylinder 1, for example equal to 200 meters. As, during regular operation, the doctor band 20 is moved in the longitudinal direction of the doctor bar 25 and the plate cylinder 1 at a low speed which can be of the order of magnitude of a few millimeters to a few centimeters per second, it is possible to achieve periods of time of the order of magnitude of between three and ten hours, before the doctor band 20 has been completely rewound from one winding device 28, 29 on to the other. For a printing operation which lasts a longer period of time, the direction of winding of the doctor band 20 can then be reversed, without a noticeable interruption in the movement of the doctor band 20 and the band 20 can be wound back on to the other winding device 28, 29 at a speed which is of the same order of magnitude. In that way, even with very long print runs, there is no longer any need for the printing machine to be stopped merely because the doctor has to be replaced.

If a doctor band 20 is damaged by a solid particle or lump in the printing ink, the drive means for the doctor band 20 can be briefly switched over to a higher speed of feed movement in order quickly to move the defective or damaged location on the doctor band 20 out of the region of contact with the plate cylinder 1. When that has been done, the doctor band 20 is wound again at the previous low feed speed. By means of a sensor device (not shown), it is possible to detect the position of damaged locations on the doctor band 20. Those positions can be stored in a memory 27 so that, whenever a defective location on the doctor band 20 which has been detected in one passage of that defective location along the plate cylinder 1 comes into the region of contact with the plate cylinder 1 after there has been a change in the direction of feed movement of the doctor band 20 and thus in a second or further passage of that defective location along the plate cylinder the band winding speed is greatly increased under the control of the memory 27 by an increase in the speed of the drive means so that the defective location is moved past the plate cylinder 1 as quickly as possible and in that way the amount of wastage which occurs in that situation is minimized. This control of the drive means by memory 27 is symbolized by arrows 34, 36 leading from memory 27 to the centers of the axes of rotation of winding devices 28, 29 in FIG. 1.

As can further be seen from the Figures, the doctor bar 25 is connected by means of two mounting arms 32, 33 pivoted to respective ones of its ends, to a rotatably mounted shaft 35 which extends parallel to the axis of rotation of the plate cylinder 1 and to which the other ends of the mounting arms 32, 33, that are remote from the doctor bar 25, are non-rotatably fixed. In that way the doctor bar 25 together with the winding devices 28, 29 and the doctor band 20 guided thereby can be pivoted away from or towards the plate cylinder 1 in such a way that the doctor band 20 can be pressed against the peripheral surface of the plate cylinder 1, with the required pressure force. To perform those pivotal and drive movements, the assembly has two actuators such as pneumatic or hydraulic piston-cylinder units 37, 38 whose piston rods 39, 40 are pivotally connected to the side of the doctor bar 25, that is remote from the plate cylinder 1, at a spacing from each other in the longitudinal direction, in such a way that the action of the force of the piston-cylinder units 37, 38 is directed transversely to the longitudinal direction of the doctor bar 25.

It will be appreciated that the above-described machine has been set forth solely by way of example and illustration of the principles of the present invention and that various modifications and alterations can be made therein without thereby departing from the spirit and scope of the invention.

What is claimed is:

1. A doctor arrangement for a rotary intaglio printing machine having a plate cylinder, having an axis of rotation, and a peripheral printing surface, comprising: a doctor bar; a doctor band mounted and guided on the doctor bar for displacement relative to the doctor bar in a direction parallel to the axis of rotation of the plate cylinder, said doctor band being pressed by said doctor bar against the peripheral surface of the plate cylinder for scraping excess ink from the plate cylinder, the doctor band being so flexible that it can be wound on and unwound about axes which extend transversely to its longitudinal direction, the length of the doctor band being substantially greater than the axial length of the plate cylinder; a respective winding device for winding and unwinding the doctor band adjacent each axial end of the plate cylinder; and a drive means for displacing the doctor band in the longitudinal direction during a printing operation whereby the doctor band is adapted to be unwound from the one winding device and wound onto the other winding device; and means to switch from a first feed speed for the doctor band corresponding to a normal operating condition to a second higher feed speed, to move a defective location of the doctor band quickly out of the region of contact with the plate cylinder.

2. A doctor arrangement as set forth in claim 1 wherein the doctor band is a metal band.

3. A doctor arrangement as set forth in claim 1 wherein said doctor bar has a slot extending in the longitudinal direction of the doctor bar, the doctor band is movably guided in the slot, and surfaces of the slot against which the doctor band bears and along which it slides are ground.

4. A doctor arrangement as set forth in claim 1 including means for reversing the direction of rotation of the drive means so that the doctor band can be alternately unwound and would by each of the winding devices.

5. A doctor arrangement as set forth in claim 1 including a memory means adapted to store the longitudinal positions of defective locations of the doctor band and to switch the drive means to said second high feed speed whenever a defective location which has been detected in an earlier passage of the doctor band passes into the region of contact of the doctor band against the plate cylinder again in a later passage, and to switch back to the first feed speed again when that defective location leaves the contact region.

6. A doctor arrangement as set forth in claim 1 wherein the plate cylinder has a horizontal axis, and wherein the doctor bar is so positioned that the doctor band is adapted to be pressed against the plate cylinder along a generatrix thereof which is disposed in the direction of rotation downstream of an ink trough associated with the plate cylinder and not above the cross-sectional center of the horizontal axis of the plate cylinder.

7. A doctor arrangement as set forth in claim 6 wherein the generatrix along which the doctor band is pressed against the plate cylinder is disposed beneath the cross-sectional center of the horizontal axis of the plate cylinder.

8. A rotary intaglio printing machine including at least one printing mechanism having a rotary plate cylinder having an axis of rotation and a peripheral printing surface, and a doctor arrangement comprising: an elongate doctor bar extending along the plate cylinder adjacent thereto in at least substantially parallel relationship with the axis of rotation thereof and having a slot extending in the doctor bar along the longitudinal direction of the doctor bar; a respective winding device arranged in the region of each of the ends of the plate cylinder; and a doctor for scraping ink from the peripheral surface of the plate cylinder; the doctor comprising an elongate doctor band which is of a length substantially greater than the axial length of the plate cylinder and which is so flexible that it can be wound and unwound about axes extending transversely to its longitudinal direction, the doctor band being disposed in the slot in the doctor bar and moved slidably in the longitudinal direction thereof by being wound between one of said winding devices and the other of said winding devices; said doctor arrangement further comprising means to switch from a first feed speed for the doctor band corresponding to a normal operating condition to a second higher feed speed, to move a defective location of the doctor band quickly out of the region of contact with the plate cylinder.

9. A machine as set forth in claim 8 including means for reversing the direction of winding of said doctor band between said winding devices.

* * * * *